US008831412B2

(12) United States Patent
Ouradnik et al.

(10) Patent No.: US 8,831,412 B2
(45) Date of Patent: Sep. 9, 2014

(54) CYLINDRICAL CANISTER HOUSING WITH INTEGRAL HEAT TRANSFER

(75) Inventors: Zachary T. Ouradnik, Racine, WI (US); Timothy J. Carlson, Racine, WI (US); Roy J. Ingold, Wind Lake, WI (US); Brian Merklein, Hartford, WI (US); Eric J. Boticki, Racine, WI (US); Jeroen Valensa, Muskego, WI (US); Michael P. Devine, Kenosha, WI (US); Gregg D. Olson, Racine, WI (US)

(73) Assignee: Modine Manufacturing Company, Racine, WI (US)

( * ) Notice: Subject to any disclaimer, the term of this patent is extended or adjusted under 35 U.S.C. 154(b) by 395 days.

(21) Appl. No.: 13/367,598

(22) Filed: Feb. 7, 2012

(65) Prior Publication Data

US 2012/0201524 A1 Aug. 9, 2012

Related U.S. Application Data

(60) Provisional application No. 61/440,818, filed on Feb. 8, 2011.

(51) Int. Cl.

| | |
|---|---|
| ***F24H 1/18*** | (2006.01) |
| ***F25D 5/00*** | (2006.01) |
| *F25B 29/00* | (2006.01) |

(52) U.S. Cl.

CPC ..... *F25D 5/00* (2013.01)
USPC ..... 392/444; 165/48.1

(58) Field of Classification Search

USPC ..... 392/444; 165/47, 48.1
See application file for complete search history.

(56) References Cited

U.S. PATENT DOCUMENTS 3,003,324 A * 10/1961 Vance et al. ..... 62/4

* cited by examiner

*Primary Examiner* — Shawntina Fuqua
(74) *Attorney, Agent, or Firm* — Michael Best & Friedrich LLP

(57) ABSTRACT

A housing for transporting a generally cylindrical canister configured to store at least one of a pressurized gas and a pressurized liquid. The housing includes a first housing section and a second housing section that is movable with respect to the first housing section from a first operating condition to a second operating condition. A heat transfer element is coupled to at least one of the first and the second housing sections to define at least a portion of a boundary of a generally cylindrical volume. The canister is generally fixed from movement with respect to the first and the second housing sections when the second housing section is in the first operating condition, and the canister is movable with respect to the first and the second housing sections and configured to be removed from the generally cylindrical volume when the second housing section is in the second operating condition.

11 Claims, 5 Drawing Sheets

CYLINDRICAL CANISTER HOUSING WITH INTEGRAL HEAT TRANSFER

CROSS REFERENCE TO RELATED APPLICATIONS

This application claims priority to U.S. Provisional Patent Application No. 61/440,818, filed Feb. 8, 2011, the entire contents of which are hereby incorporated by reference herein.

BACKGROUND

Cylindrical canisters provide advantages for storing and transporting pressurized gases and liquids due to their inherent ability to withstand internal pressure loadings. In some applications it may be desirable for heat energy to be transferred through the canister wall to or from the contents of the canister. By way of example only, such canisters can be used to store and transport a gas, such as ammonia, that is adsorbed onto the surfaces of a solid metal chloride contained within the canister. Typically such a chemical adsorption reaction is either endothermic (requiring the addition of heat in order to proceed isothermally) or exothermic (requiring the removal of heat in order to proceed isothermally). Likewise, the corresponding desorption reaction will be exothermic if the adsorption reaction is endothermic, and vice versa. By allowing heat energy to readily transfer through the canister walls, the gas can be advantageously adsorbed or desorbed as desired through the addition or removal of heat.

The efficient transfer of heat energy to or from the surface of the canister requires that good thermal contact be maintained between the heat source/sink and the canister surface. This can be complicated by variations in the cylindrical canister surface, as may be the result of wear, manufacturing tolerances, deformation due to pressure cycling, and other factors. As a further complication, it is sometimes desirable to allow for easy replacement of the cylindrical canisters, thus necessitating the ability to at least temporarily remove the contact pressure that may be used to ensure the aforementioned good thermal contact between the canister and the heat source/sink.

SUMMARY

In one embodiment the invention provides a housing for transporting a generally cylindrical canister configured to store at least one of a pressurized gas and a pressurized liquid. The housing includes a first housing section and a second housing section movably coupled to the first housing section. The second housing section is movable with respect to the first housing section from a first operating condition to a second operating condition. The first housing section and the second housing section at least partially define a generally cylindrical volume having a boundary defined by the housing in the first operating condition. A heat transfer element is coupled to at least one of the first and the second housing sections to define at least a portion of the boundary of the generally cylindrical volume, and the heat transfer element is operable to transfer heat between the heat transfer element and the canister. The canister is generally fixed from movement with respect to the first and the second housing sections when the second housing section is in the first operating condition and the canister is positioned in the generally cylindrical volume, and the canister is movable with respect to the first and the second housing sections and configured to be removed from the generally cylindrical volume when the second housing section is in the second operating condition.

Some embodiments of the invention provide a canister housing including two or more housing sections. The relative positions of the two or more housing sections are fixed in a first operating condition, and at least one of the two or more housing sections is movable with respect to at least one other of the two or more housing sections in a second operating condition. The two or more housing sections together at least partially define a cylindrical volume interior to the canister housing. A heat transfer element is arranged within at least one of the two or more housing sections and includes a thermally conductive surface that defines at least a portion of the boundary of the cylindrical volume.

In some embodiments, the canister housing includes a releasable securing mechanism to fix the relative positions of the two or more housing sections in the first operating condition. In some such embodiments the releasable securing mechanism is capable of being released without the use of tools.

In some embodiments, an axis is provided about which the at least one or more housing sections that is movable with respect to at least one other of the two or more housing sections can pivot in the second operating condition. In some such embodiments the axis is oriented parallel to the axis of the cylindrical volume. In some other such embodiments the axis is oriented transverse to the axis of the cylindrical volume.

In some embodiments, the heat transfer element comprises an electrical resistance heating element. In some other embodiments the heat transfer element comprises a fluid flow conduit. In some such other embodiments the fluid flow conduit comprises a plurality of flat tubes arranged between first and second headers.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

Figure 1:
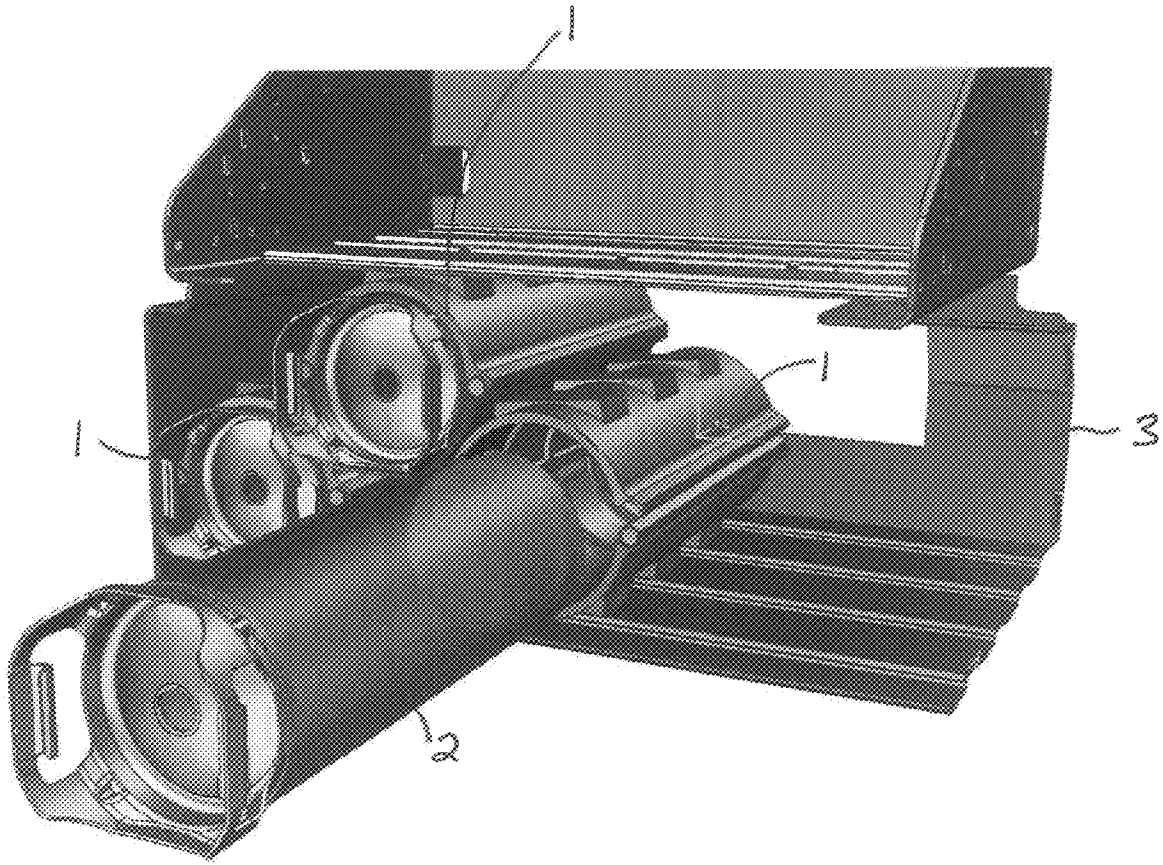
FIG. 1 is a perspective view of an embodiment of the invention.
Figure 2:
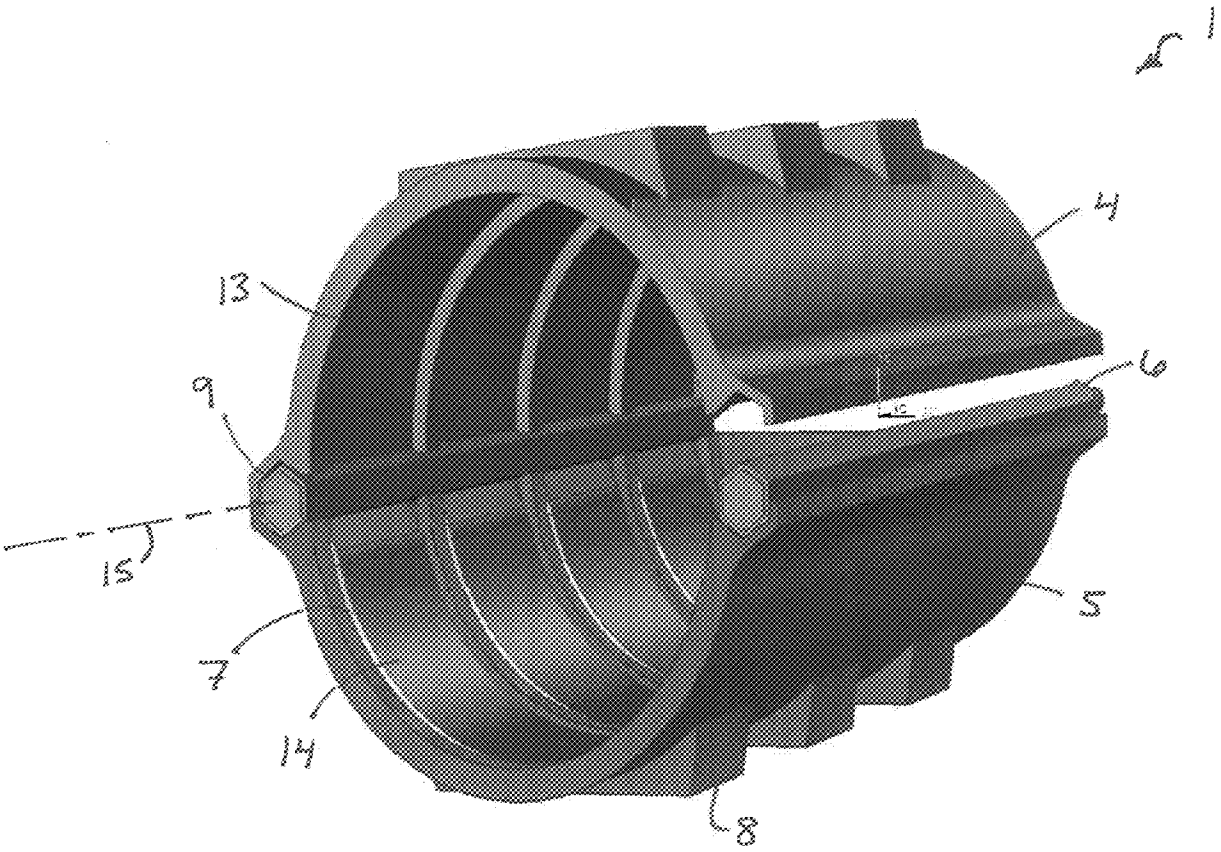
FIG. 2 is a perspective view of selected portions of the embodiment of FIG. 1.

The exemplary embodiment of FIGS. 1 and 2 includes one or more (three in the case of FIG. 1) housings 1, each arranged to receive a cylindrical canister 2. The canisters 2 can be used to store and/or transport a pressurized liquid or gas, and in some (but not all) cases may be used to store and/or transport a gas that is adsorbed onto a solid substrate. The housings 1 can be optionally mounted to a frame 3, which can in turn be mounted to a machine, vehicle, system, etc. (not shown). Mounting of the housing 1 can be accomplished by way of integral mounting feet 8 (FIG. 2).

With specific reference to FIG. 2, the housing 1 includes a first housing section 4 and a second housing section 5. Together the housing sections 4, 5 partially define a cylindrical volume 13 located within the housing 1. It should be understood that a housing 1 can in some embodiments include additional housing sections, and that such additional housing sections can also partially define the cylindrical volume 13. In the embodiment of FIG. 1 and FIG. 2 the housing sections 4, 5 are identical to one another. However, in other embodiments the housing sections are non-identical.

In a first operating condition the positions of the two housing sections 4, 5 are fixed with respect to one another. In the embodiment of FIG. 1, the leftmost two housings 1 are shown in such a first operating condition, and each has a canister 2 receivably located within their respective cylindrical volumes 13. In contradistinction, the rightmost housing 1 of FIG. 1 and the housing 1 of FIG. 2 are shown in a second operating condition wherein the housing section 4 is movable with respect to the housing section 5.

In the embodiment of FIG. 2, the housing section 5 includes a heat transfer element 6. Although the embodiment of FIG. 2 shows the heat transfer element 6 to be only in the housing section 5, in other embodiments a heat transfer element may additionally or alternatively be provided in the housing section 4, and/or in additional housing sections as may be present. The housing section 5 includes at least one recess 7 for the heat transfer element 6.

Figure 3:
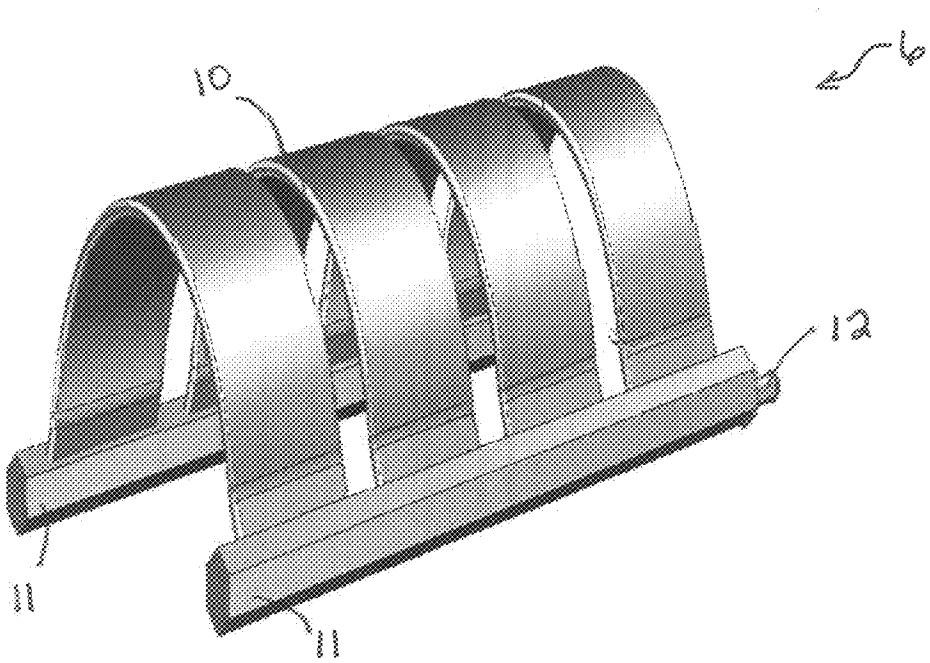
FIG. 3 is a perspective view of a heat transfer element for use in some embodiments of the invention.

The heat transfer element 6 (shown in detail in FIG. 3) includes first and second manifolds 11 joined by flat tubes 10. In some embodiments, internal passages located within the flat tubes 10 allow for the transport of fluid between the manifolds 11. A port 12 is joined to each of the manifolds 11 and can allow for a heating and/or cooling fluid to flow into and out of the heat transfer element 6. The heat transfer element 6 provides a thermally conductive surface 14 which forms a portion of the cylindrical volume 13, so that heat can be readily transferred between the heat transfer element 6 and the canister 2. The thermally conductive surface 14 can comprise walls of the flat tubes 10, as shown in the exemplary embodiment. In other embodiments, however, the thermally conductive surface 14 can be a separate metallic plate that is metallurgically bonded to the flat tubes 10. It should be understood that, although four flat tubes 10 are shown in the exemplary embodiment, in other embodiments the number of flat tubes 10 may be greater or lesser.

In some embodiments, the heat transfer element 6 can operate by way of electric resistance heating rather than by fluid transport. Multiple resistive elements can be provided within the flat tubes 10 in place of the internal fluid passages, and the ports 12 can be used to provide connection between the resistive elements and an external electrical circuit (not shown) in order to allow for the flow of electrical current through the resistive elements.

The housing sections 4, 5 include channels 9 to receive the manifolds 11. A pivot axis 15 extending in the axial direction of the cylindrical volume 13 is provided alongside one of the manifolds 11. In the second operating condition the housing section 4 rotates about the pivot axis 15, so that a canister 2 can be readily inserted or removed from the cylindrical volume 13.

In some embodiments good thermal contact between the canister 2 and the heat transfer element 6 can be maintained, when in the first operating condition, by a compliant member within the housing 1. For example, one or more strips of rubber, foam, elastomer, or other compliant material may be provided within one or more of the housing sections, the compression thereof providing a contact pressure between the canister and the surfaces 14.

Figure 4:
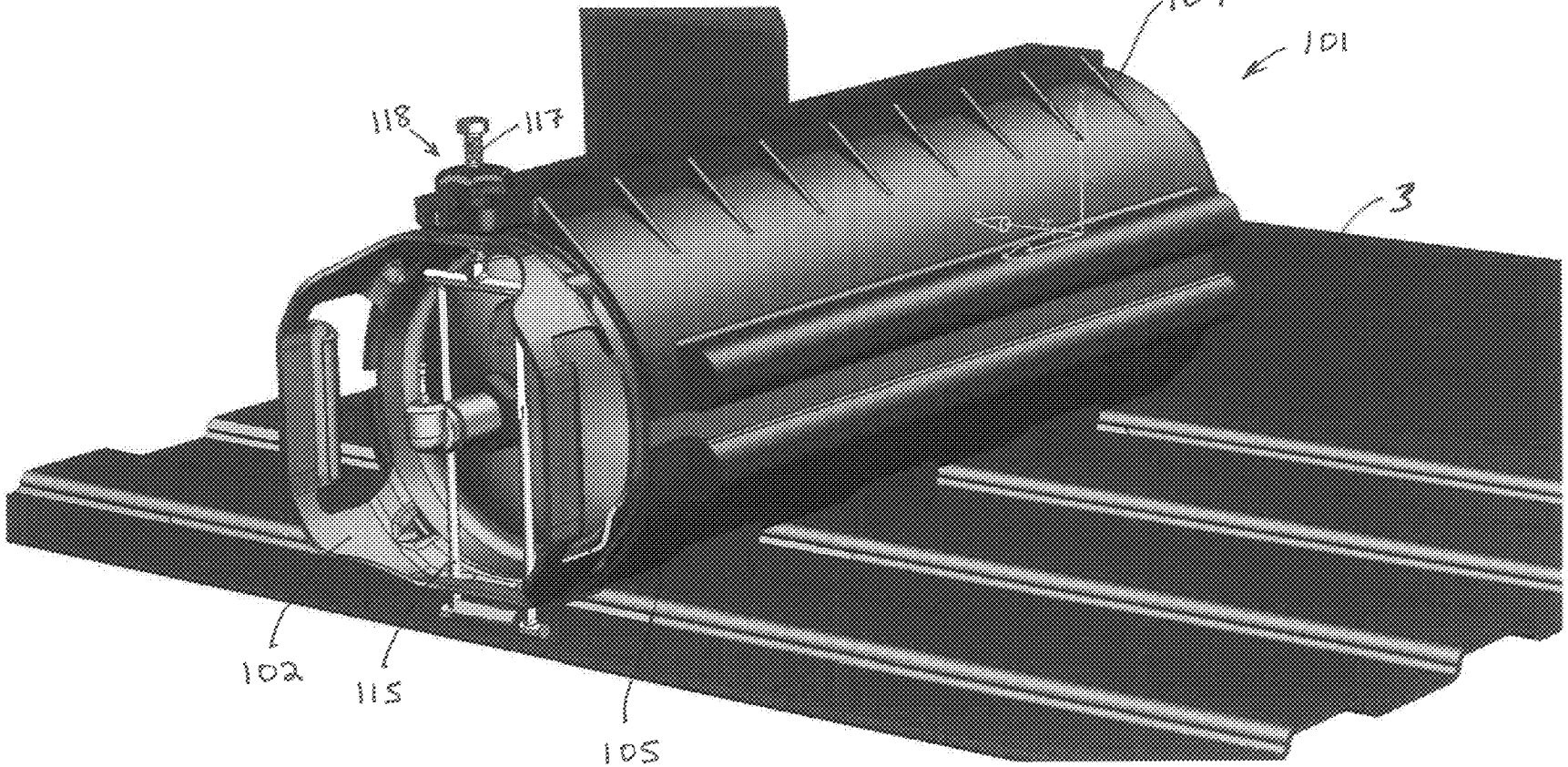
FIG. 4 is a perspective view of another embodiment of the invention.
Figure 5:
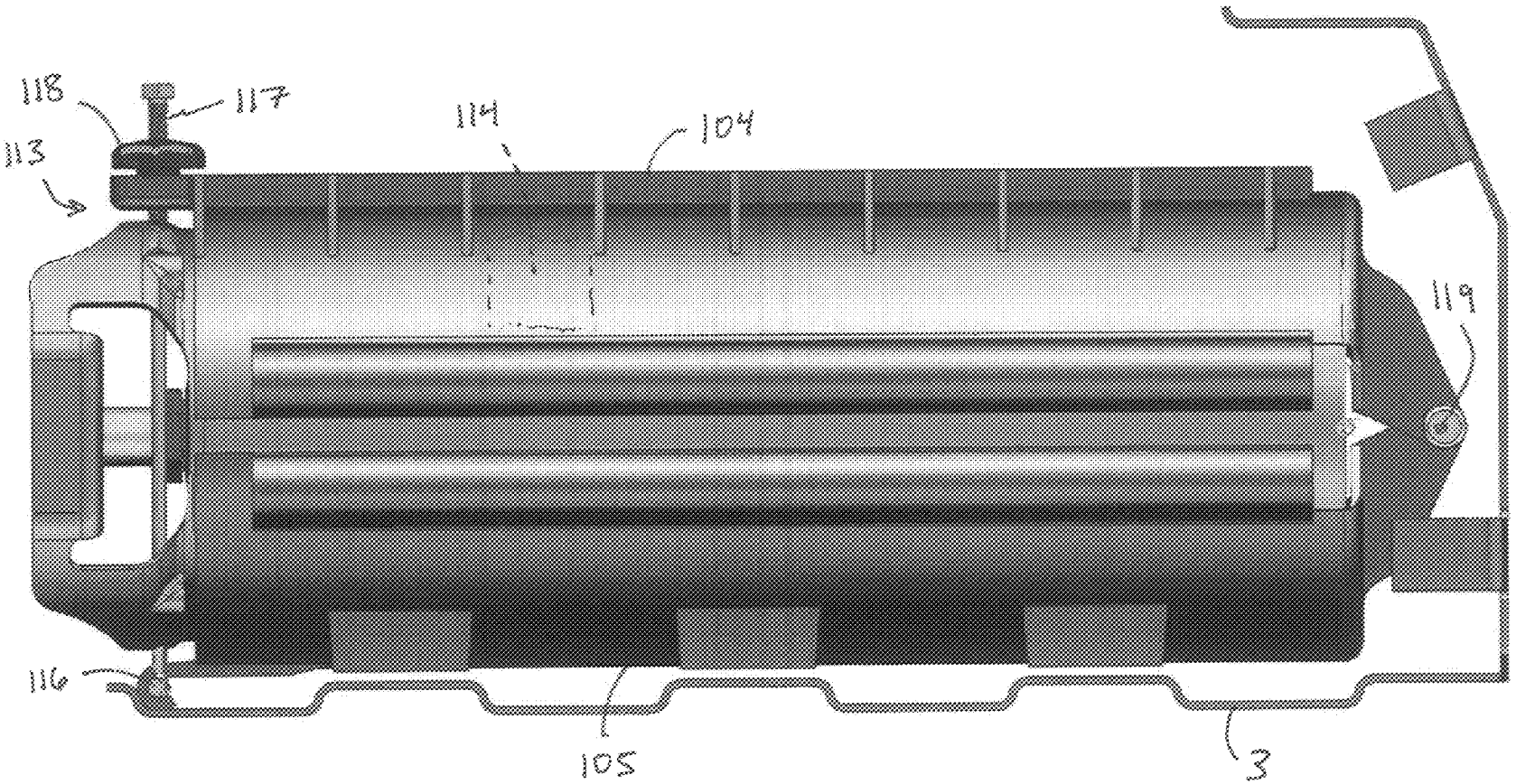
FIG. 5 is an elevation view of the embodiment of FIG. 4.

In the alternate embodiment of FIGS. 4 and 5, a housing 101 includes housing sections 104 and 105 to together partially define a cylindrical volume 113 wherein a canister 112 can be received. A pivot axis 119 oriented transverse to the axial direction of the cylindrical volume 113 is located at an end of the housing 101, and allows for the rotation of housing section 104 relative to housing section 105 so that a canister 102 can be readily inserted or removed from the cylindrical volume 113.

The housing section 105 includes a pivot axis 116 located at the opposite end of the housing 101 from the pivot axis 119. A locking bar 115 is pivotable about the pivot axis 116, and includes a threaded rod section 117. In a first operating condition (shown in FIGS. 4 and 5) a releasable securing mechanism 118 is assembled to the threaded rod section 117 and engages the housing section 104 in order to apply a tensile load to the locking bar 115. This tensile load prevents the rotation of the housing section 104 about the pivot axis 119 and ensures that thermal contact between the canister 102 and the thermally conductive surfaces 114 is maintained. In addition, the location of the locking bar 115 can prevent the axial movement of the canister 102.

In a second operating condition, the releasable securing mechanism 118 is disengaged from the housing section 104 and the locking bar 115 is rotated about the pivot axis 116 so as to no longer obstruct the axial movement of the canister 102. The housing section 104 is rotated about the pivot axis 119 so that a canister 102 can be readily inserted or removed from the cylindrical volume 113.

The releasable securing mechanism 118 can be assembled to the threaded rod section 117 by way of internal threads corresponding to the external threads of the threaded rod section 117, so that the releasable securing mechanism 118 can translate along the axis of the threaded rod section 117 by rotation about that axis. In some embodiments the releasable securing mechanism 118 can be of an appropriate size and shape so that it can be manipulated along the threaded rod section 117 without the use of tools, i.e. by an operator using his or her hand to rotate the threaded clamp 118. It may be especially preferable, in some embodiments, for the releasable securing mechanism 118 to be rotatable by hand by an operator wearing gloves.

The releasable securing mechanism 118 can be used to change the operating condition of the housing 101 from the aforementioned first operating condition to the aforementioned second operating condition. Although the exemplary embodiment shows the releasable securing mechanism 118 to be a threaded clamp engaging a threaded rod section 117, it should be understood by one having ordinary skill in the art that other types of fasteners such as draw latches, pivoting clamps, spring members, quick-release pins, cam lock handles and linkages, and the like may be substituted to achieve substantially similar effect.

Various alternatives to the certain features and elements of the present invention are described with reference to specific embodiments of the present invention. With the exception of features, elements, and manners of operation that are mutually exclusive of or are inconsistent with each embodiment described above, it should be noted that the alternative features, elements, and manners of operation described with reference to one particular embodiment are applicable to the other embodiments.

The embodiments described above and illustrated in the figures are presented by way of example only and are not intended as a limitation upon the concepts and principles of the present invention. As such, it will be appreciated by one having ordinary skill in the art that various changes in the elements and their configuration and arrangement are possible without departing from the spirit and scope of the present invention.

What is claimed is:

1. A housing for transporting a generally cylindrical canister configured to store at least one of a pressurized gas and a pressurized liquid, the housing comprising:

a first housing section;

a second housing section movably coupled to the first housing section, the second housing section movable with respect to the first housing section from a first operating condition to a second operating condition, the first housing section and the second housing section at least partially define a generally cylindrical volume having a boundary defined by the housing in the first operating condition;

a heat transfer element coupled to at least one of the first and the second housing sections to define at least a portion of the boundary of the generally cylindrical volume, and the heat transfer element operable to transfer heat between the heat transfer element and the canister, wherein the canister is generally fixed from movement with respect to the first and the second housing sections when the second housing section is in the first operating condition and the canister is positioned in the generally cylindrical volume, and wherein the canister is movable with respect to the first and the second housing sections and configured to be removed from the generally cylindrical volume when the second housing section is in the second operating condition;

wherein the generally cylindrical volume defines a longitudinal axis, wherein the second housing section is movably coupled to the first housing section such that the second housing section pivots about a pivot axis with respect to the first housing section, and wherein the pivot axis is parallel to the longitudinal axis of the generally cylindrical volume.

2. The housing of claim 1, further comprising, a releasable securing mechanism configured to retain the second housing section in the first operating condition.

3. The housing of claim 2, wherein the releasable securing mechanism is manually operable without the use of a tool.

4. The housing of claim 1, wherein the heat transfer element includes a fluid flow conduit.

5. The housing of claim 4, wherein the heat transfer element includes a first manifold and a second manifold, and wherein the fluid flow conduit extends between the first and the second manifolds.

6. The housing of claim 5, wherein the first manifold includes a port configured to place the heating transfer element in fluid communication with one of a heating and a cooling source.

7. The housing of claim 1, wherein the heat transfer element includes an electric resistance heating element.

8. A housing for transporting a generally cylindrical canister configured to store at least one of a pressurized gas and a pressurized liquid, the housing comprising:

a first housing section;

a second housing section movably coupled to the first housing section, the second housing section movable with respect to the first housing section from a first operating condition to a second operating condition, the first housing section and the second housing section at least partially define a generally cylindrical volume having a boundary defined by the housing in the first operating condition;

a heat transfer element coupled to at least one of the first and the second housing sections to define at least a portion of the boundary of the generally cylindrical volume, and the heat transfer element operable to transfer heat between the heat transfer element and the canister, wherein the canister is generally fixed from movement with respect to the first and the second housing sections when the second housing section is in the first operating condition and the canister is positioned in the generally cylindrical volume, and wherein the canister is movable with respect to the first and the second housing sections and configured to be removed from the generally cylindrical volume when the second housing section is in the second operating condition;

wherein the heat transfer element includes an electric resistance heating element.

9. The housing of claim 8, further comprising, a releasable securing mechanism configured to retain the second housing section in the first operating condition.

10. The housing of claim 9, wherein the releasable securing mechanism is manually operable without the use of a tool.

11. The housing of claim 8, wherein the generally cylindrical volume defines a longitudinal axis, wherein the second housing section is movably coupled to the first housing section such that the second housing section pivots about a pivot axis with respect to the first housing section, and wherein the pivot axis is parallel to the longitudinal axis of the generally cylindrical volume.

* * * * *